US007887607B2

(12) United States Patent
Kim

(10) Patent No.: US 7,887,607 B2
(45) Date of Patent: Feb. 15, 2011

(54) METHOD FOR PREPARING COATED ABRASIVE HAVING THREE-DIMENSIONAL ABRASIVE STRUCTURES

(75) Inventor: Jeung Woon Kim, Seoul (KR)

(73) Assignee: Suntek Industries Ltd., Pyeongtaek-si (KR)

( * ) Notice: Subject to any disclaimer, the term of this patent is extended or adjusted under 35 U.S.C. 154(b) by 246 days.

(21) Appl. No.: 12/298,106

(22) PCT Filed: Dec. 10, 2007

(86) PCT No.: PCT/KR2007/006392
§ 371 (c)(1),
(2), (4) Date: Oct. 22, 2008

(87) PCT Pub. No.: WO2008/069634
PCT Pub. Date: Jun. 12, 2008

(65) Prior Publication Data

US 2009/0173013 A1 Jul. 9, 2009

(30) Foreign Application Priority Data

Dec. 8, 2006 (KR) ..... 10-2006-0124770

(51) Int. Cl.
*B24B 1/00* (2006.01)
*B05D 1/12* (2006.01)
*B05D 1/36* (2006.01)

(52) U.S. Cl. ..... 51/295; 51/298; 427/180; 427/202

(58) Field of Classification Search ..... 427/180, 427/202, 204, 205, 427; 51/293–297, 307–309; 156/279; 76/81–81.8; 451/463, 489–495, 451/504–539; 524/541, 793; 15/230.12–230.16
See application file for complete search history.

(56) References Cited

U.S. PATENT DOCUMENTS 5,201,916 A * 4/1993 Berg et al. ..... 51/293
5,213,589 A * 5/1993 Ronning et al. ..... 51/293
5,213,591 A * 5/1993 Celikkaya et al. ..... 51/293
5,578,095 A 11/1996 Bland et al.
5,582,672 A * 12/1996 Follett et al. ..... 51/295
5,681,217 A * 10/1997 Hoopman et al. ..... 451/528
5,690,705 A * 11/1997 Holmes et al. ..... 51/295
5,776,290 A * 7/1998 Follett et al. ..... 51/295
5,834,109 A * 11/1998 Follett et al. ..... 428/323
5,924,917 A * 7/1999 Benedict et al. ..... 451/526
5,975,988 A * 11/1999 Christianson ..... 451/28
6,773,475 B2 8/2004 Ohishi
6,776,868 B2 * 8/2004 Follensbee ..... 51/295
6,949,128 B2 9/2005 Annen
2001/0046835 A1 * 11/2001 Wielonski et al. ..... 451/533
2002/0026752 A1 * 3/2002 Culler et al. ..... 51/298
2003/0172594 A1 * 9/2003 Castro et al. ..... 51/307
2003/0205320 A1 * 11/2003 Follensbee ..... 428/143
2005/0118939 A1 * 6/2005 Duescher ..... 451/527

* cited by examiner

*Primary Examiner*—Jerry Lorengo
*Assistant Examiner*—Ross J Christie
(74) *Attorney, Agent, or Firm*—Rothwell, Figg, Ernst & Manbeck, P.C.

(57) ABSTRACT

The method of the subject invention, which comprises (a) forming a plurality of abrasive structures having a three-dimensional shape on a backing by using a first abrasive slurry and drying the abrasive structures, and (b) spray-coating in a specific way a second abrasive slurry over the three-dimensional abrasive structures to form a coating layer and drying the coating layer, provides a coated abrasive having improved flexibility, surface roughness, and use life.

20 Claims, 7 Drawing Sheets

A° = atan(H/(D-R/2))

Prior Art

Prior Art

Prior Art

Prior Art screen mesh plane view cross-sectional view $$A^\circ = \mathrm{atan}(H/(D-R/2))$$

METHOD FOR PREPARING COATED ABRASIVE HAVING THREE-DIMENSIONAL ABRASIVE STRUCTURES

CROSS REFERENCE TO RELATED APPLICATIONS

This application is a 35 USC §371 National Phase Entry Application from PCT/KR2007/006392, filed Dec. 10, 2007, and designating the United States, which claims priority under 35 U.S.C. §119 to Korean Patent Application No. 10-2006-0124770 filed Dec. 8, 2006, which is incorporated herein in its entirety.

FIELD OF THE INVENTION

The present invention relates to a method for preparing a coated abrasive having three-dimensional abrasive structures.

BACKGROUND OF THE INVENTION

A conventional coated abrasive comprising a backing and an abrasive layer is prepared by (i) applying an adhesive resin on the backing to form a first adhesive layer (a make coat), (ii) sprinkling abrasive grains on the first adhesive layer, (iii) pre-drying, (iv) applying a second adhesive layer (a size coat) on the abrasives deposited on the first adhesive layer, and (v) drying.

Such conventional coated abrasive shown in FIG. 1 has problems in that (i) the abrasive grains deposited in the abrasive layer tend to fall off during use, and (ii) in case of grinding an alloy steel or a nonferrous metal article, the coated abrasive undergoes degradation brought about by the frictional heat. In order to solve these problems, U.S. Pat. Nos. 3,997,302 and 4,770,671 disclose a method of adding a grinding aid to the second adhesive layer, but the use life of the coated abrasive is not significantly improved.

Modified coated abrasives have been proposed as described below. FIG. 2 shows a coated abrasive comprising two abrasive layers, disclosed in Korean Patent No. 486,954. However, its flexibility is not satisfactory for use for grinding a curved surface: because a limited amount of filler can be used in the first adhesive layer, the first abrasive layer does not undergo even wearing during dry sanding. In addition, the improved cutting performance rate by about 20 to 30% is only marginal in light of the fact that the production cost thereof becomes 70 to 80% higher.

Korean Patent No. 398,942 discloses a method for forming three-dimensional structures containing abrasive grains as shown in FIG. 3, by applying a slurry containing abrasive grains on a backing using an intaglio knurling tool and drying the resulting sheet by UV radiation. However, the coated abrasive prepared by this method has much poorer early-stage cutting performance characteristics as compared with the conventional coated abrasive shown in FIG. 1. Further, in case of heavy duty sanding, the three-dimensional structures undergo rapid wearing and thus it is useful only for finishing.

Further, U.S. Pat. No. 4,364,746 discloses a method for preparing a coated abrasive by applying agglomerated minerals on an adhesive layer formed on a backing (FIG. 4). However, the coated abrasive prepared by this method has problems in that (i) the irregular form of the agglomerated minerals tends to create scratches on the work piece surface, and (ii) its manufacturing cost is high.

SUMMARY OF THE INVENTION

Accordingly, it is an object of the present invention to provide a method for preparing a coated abrasive having improved durability and flexibility in a simple and economical way.

In order to attain this object, one aspect of the present invention provides a method for preparing a coated abrasive having three-dimensional abrasive structures, comprising:

(a) forming a plurality of abrasive structures having a three-dimensional shape on a backing by using a first abrasive slurry and drying the abrasive structures, and (b) spray-coating a second abrasive slurry over the three-dimensional abrasive structures to form a coating layer thereon and drying the coating layer, wherein the second abrasive slurry is sprayed over the abrasive structures at an angle (A) calculated by formula I:

$$A=\text{atan}\{H/(D-R/2)\} \quad \text{(I)}$$

in which A is the angle between the line of spray and the horizontal line, H and R are a height (μm) and a diameter (μm) of the three-dimensional abrasive structure, respectively, and D is the distance (μm) between two adjacent three-dimensional abrasive structures.

In addition, another aspect of the present invention provides a method for preparing a coated abrasive having three-dimensional abrasive structures, comprising:

(a) forming a plurality of abrasive structures having a three-dimensional shape on a backing by using a first abrasive slurry and drying the abrasive structures, and (b) spray-coating a second abrasive slurry over the three-dimensional abrasive structures to form a coating layer thereon and drying the coating layer, wherein the second abrasive slurry is sprayed over the abrasive structures with an angle (A) calculated by the formula I:

$$A=\text{atan}\{H/(D-R/2)\} \quad \text{(I)}$$

(c) electrostatic-coating abrasive grains on the first adhesive coating, and (d) spray-coating a second adhesive composition over the electrostatic coated abrasive to form a coating layer thereon and drying the coating layer, in which the second adhesive composition is sprayed over the electrostatic coated abrasive at an angle (A') calculated by the formula II:

$$A'=\text{atan}\{H'/(D-R/2)\} \quad \text{(II)}$$

in which A or A' is the angle between the line of spray and the horizontal line, H and R are a height (μm) and a diameter (μm) of the three-dimensional abrasive structure, respectively, H' is the height of the three-dimensional abrasive structures obtained in (b), and D is the distance (μm) between two adjacent three-dimensional abrasive structures.

BRIEF DESCRIPTION OF THE DRAWINGS

The above and other objects and features of the present invention will become apparent from the following description of the invention, when taken in conjunction with the accompanying drawings, which respectively show.

DETAILED DESCRIPTION OF THE INVENTION

Figure 1:
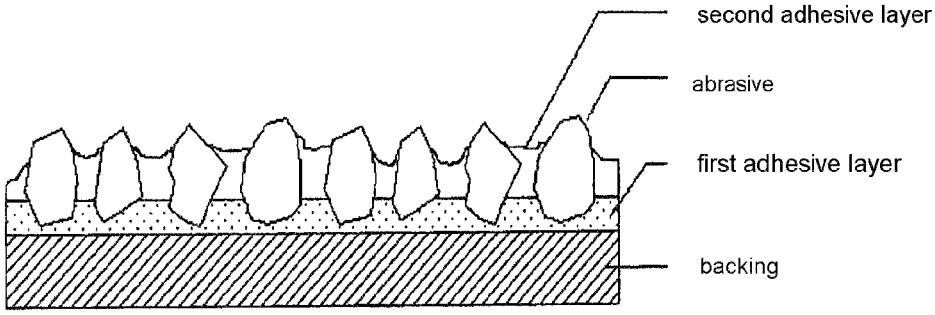
FIGS. 1 to 4: cross-sectional views of conventional coated abrasives.

A method for preparing a coated abrasive according to the present invention is characterized in that an abrasive slurry or an adhesive composition is coated on a plurality of isolated three-dimensional abrasive structures formed on a backing by spray-coating such that the spraying line forms a specific angle with respect to the horizontal line.

According to a preferable embodiment of the present invention, the three-dimensional abrasive structures may be formed by coating a first abrasive slurry on a backing by using a screen mesh roll coater.

The first abrasive slurry used in the present invention comprises 40 to 70% by weight of an abrasive, 20 to 50% by weight of an adhesive and 2 to 30% by weight of a filler based on the total weight of the solid phase in the slurry. The slurry is prepared by mixing the above components in a suitable amount of water, an organic solvent or mixture thereof. Preferably, the slurry has a viscosity of 25,000 to 60,000 centipoise (25° C.), and a solid content of 80 to 95% by weight. Any abrasives, adhesives and fillers, known in the relevant art may be used. Preferable examples of the abrasive component may include alumina ($Al_2O_3$), silicon carbide (SiC), alumina zirconia (AZ), ceramic, and a mixture thereof. It is preferable for the abrasive to have a grain diameter of 0.5 to 400 μm. Preferable examples of the adhesive component include a UV curable resin such as polyester acrylate oligomer, epoxy acrylate oligomer, urethane acrylate oligomer, bifunctional aliphatic urethane acrylate oligomer and flexible aliphatic urethane acrylate oligomer; a thermosetting resin such as phenol resin, epoxy resin, melamine resin, urea resin, urea-melamine copolymerized resin, urethane resin, polyester resin; and a mixture thereof. Preferable examples of the filler component are $CaCO_3$, clay, $SiO_2$, pumice, feldspar, cryolite, $KBF_4$ and mixtures thereof.

If needed, the first abrasive slurry may further comprise a conventional reactive diluent such as trimethylpropane triacrylate (TMPTA), dipentaerithritol penta/hexaacrylate (DPHA), and tripropyleneglycol diacrylate (TPGDA), a photoinitiator, a thixotropic agent, a coupling agent, and a dispersing agent.

The first abrasive slurry may be coated on a backing in an amount of 100 to 1,000 g/m$^2$. When a UV curable resin is used as an adhesive, the first abrasive slurry coated on the backing may be dried under electromagnetic radiation at a wavelength of 300 to 600 nm with a UV dryer for 3 to 10 seconds. When a thermosetting resin is used as an adhesive, the slurry may be dried with a radiation heater or a conduction heat type dryer at a temperature of 90 to 140° C. for 10 to 20 minutes. The UV dryer (light source) may be equipped with a high pressure mercury lamp, a super high pressure mercury lamp, a xenon lamp, a metal halide lamp.

As a backing, any of those known in the relevant art may be used. Examples of a backing include cotton fabrics, polyester fabrics, cotton/polyester mixed yarn fabric, rayon fabrics, polyethyleneterephthalate (PET) film, paper, and a mixture thereof.

The hole size of the screen mesh roll coater preferably used in the present invention varies depending on the size of the abrasive grain and the desired size of the three-dimensional abrasive structures. For example, the hole may have a diameter of 300 to 2,000 μm.

The three-dimensional abrasive structures formed with the first abrasive slurry may have various shapes, for example cone, hemisphere, cylinder or square pillar, depending on the hole shape of the screen mesh roll coater used and the fluidity (viscosity) of the first abrasive slurry. Preferably, the structure has a diameter of 300 to 2,500 μm and a height of 300 to 1,000 μm. In addition, the distance between two adjacent three-dimensional abrasive structures is preferably 500 to 3,000 μm.

Subsequently, according to the method of the present invention, a coating layer may be formed on the three-dimensional abrasive structures (i) by spray-coating a second abrasive slurry at a specific angle (A) calculated by formula I, or (ii) by spray-coating of the first adhesive composition at an angle (A) calculated by the formula I, conducting an electrostatic-coating of abrasive grains, and subsequently spray-coating a second adhesive composition at an angle (A') calculated by formula II.

Figure 7:
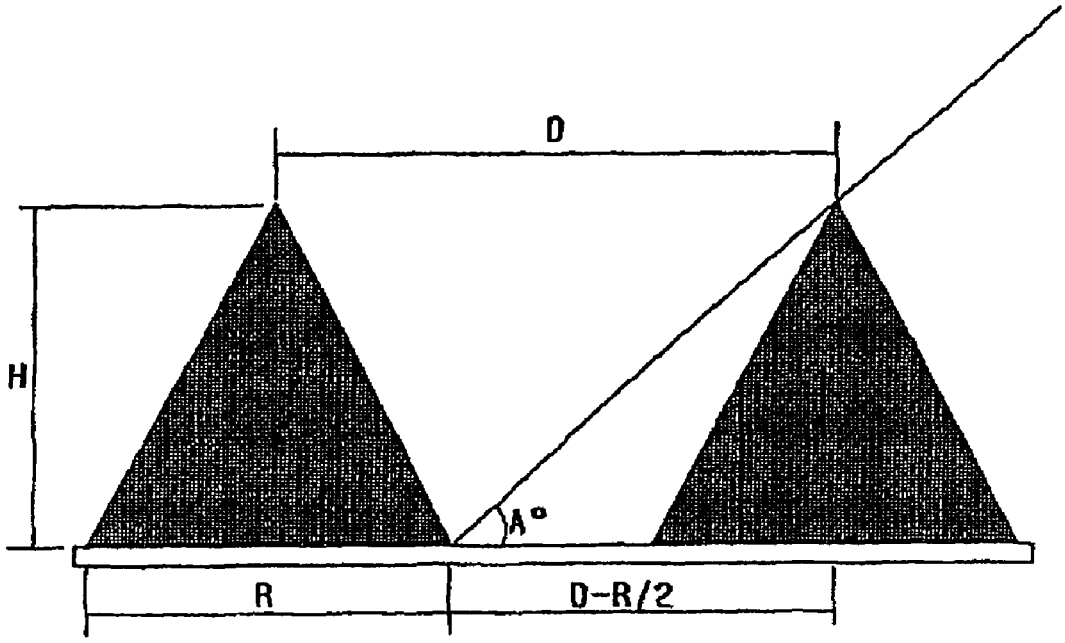
FIG. 7: a schematic diagram illustrating the parameters H, R and D in formulas I.

The parameters, A, H, R and D are shown in FIG. 7. The spray angle, A or A', corresponds to the angle formed between the line of spraying and the horizontal line and it varies depending on the shape and size of the three-dimensional abrasive structures and the distance therebetween. Further, other process parameters such as the rate of moving the substrate sheet during the spraying, airflow, and others should be considered.

For example, corn-shaped three-dimensional abrasive structures may have a diameter of 300 to 2,500 μm and a height of 300 to 1,000 μm, and the distance between the structures may be in the range of 500 to 3,000 μm. The suitable spray angle calculated by the formula I for this case is 10 to 700, preferably 15 to 50°.

In order to obtain a uniform coating, it is preferable to conduct the spray-coating on the three-dimensional abrasive structures by using one or more injection nozzles located in the front of the substrate sheet or in the back thereof. The injection nozzles may oscillate horizontally. The sprayed slurry may form a fan-shaped spray pattern having a spread angle of about 10 to 60° and the plane of the fan defining said spray angle corresponds to the above mentioned spray angle.

The spray-coating at a specific angle according to the present invention allows the abrasive slurry or the adhesive composition to coat only the surfaces of the three-dimensional abrasive structures, i.e., the top and side surfaces of the structures. If the slurry or composition is sprayed at an angle outside of the range calculated by formula I or II, the slurry or composition may coat not only the surfaces of the three dimensional abrasive structures but also the exposed surface (valley) between the structures, leading to low cutting performance and flexibility of the resulting coated abrasive. Namely, if the spray angle is too large, abrasive grains are deposited on the backing surface to reduce the life time and the flexibility of the resulting coated abrasive. When the spray angle is too small, the abrasive grains are concentrated on the top of the three-dimensional abrasive structures, leading to rapid deterioration of its performance during use (stock removal or cutting power).

A second abrasive slurry coated on the three-dimensional structures may comprise an abrasive, an adhesive and a filler component which are analogous to those used for the first abrasive slurry. The first and second abrasive slurrys may or may not have the same composition. It is preferable that the second abrasive slurry has a viscosity of 1,000 to 3,000 centipoise (at 25° C.) and a solid content of 60 to 80% by weight.

The slurry may be coated on the three-dimensional abrasive structures in an amount of 500 to 1,200 g/m$^2$. The adhesive of the second abrasive slurry preferably includes a thermosetting resin such as phenol resin, epoxy resin, melamine resin, urea resin, urea-melamine copolymerized resin, urethane resin and polyester resin. When a UV curable resin is used as an adhesive, the spray-coated layer may be dried under electromagnetic radiation at a wavelength of 300 to 600 nm for 3 to 10 seconds. When a thermosetting resin is used as an adhesive, it may be dried with a radiation heater or a conduction heat type dryer at a temperature of 90 to 140° C. for 60 to 100 minutes.

In addition, in accordance with another embodiment of the present invention, the spray-coating of a first adhesive composition (e.g., the weight ratio of the adhesive to the filler=60~90:10~40) may be followed by an electrostatic coating of abrasive grains and drying at a temperature of 90 to 140° C. for 40 to 60 minutes, to form a first adhesive layer in which abrasive grains are dispersed. Then, the spray-coating of a second adhesive composition (e.g., the weight ratio of the adhesive to the filler=60~90:10~40) on the first adhesive layer may be followed by drying at a temperature of 90 to 140° C. for 60 to 100 minutes, to form a second adhesive layer. Conventional adhesives and fillers known in the relevant art may be used to form the first and second adhesive layer.

The first adhesive composition preferably has a viscosity of 1,000 to 2,000 centipoise (at 25° C.) and a solid content of 70 to 80% by weight, and may be coated in an amount of 70 to 250 g/m$^2$. The second adhesive composition preferably has a viscosity of 500 to 2,000 centipoise (at 25° C.) and a solid content of 60 to 80% by weight, and may be coated in an amount of 50 to 300 g/m$^2$. The abrasive grains may be coated in an amount of 100 to 600 g/m$^2$.

Such pre-cured coated abrasive may be wound in the form of a roll and subsequently final cured at a temperature of 100 to 120° C. for 6 to 10 hours. In order to further improve the flexibility, the cured coated abrasive may be flexed once or twice.

The coated abrasive prepared by the inventive method comprising (i) a backing, (ii) three-dimensional abrasive structures formed on the backing, and (iii) the abrasive coating layer formed on the abrasive structures has an improved flexibility and surface roughness, and, thus, it can be effectively used regardless of the curvature of the substrate surface. In addition, durability of the inventive coated abrasive is much longer than a conventional coated abrasive.

The following Examples and Comparative Examples are given for the purpose of illustration only, and are not intended to limit the scope of the invention.

Example 1

24 g of Polyester acrylate oligomer EB830 of (UCB, MW 1,500), 10 g of tripropyleneglycol acrylate, 2.5 g of thixotropic agent Attagel-50 (Engelhard), 0.06 g of coupling agent B515.1 2H (Chartwell), 2 g of cryolite (Onoda), 1.44 g of a long wavelength photoinitiator TPO (Ciba-Geigy), and 60 g of silicon carbide #320 abrasive (ESK) were mixed with 6.38 g of propyleneglycol methyl ether resulting in a first abrasive slurry having a viscosity of 45,000 centipoise (at 25° C.) and a solid content of 95% by weight.

Meanwhile, 25 g of a phenol resin HP-41 (Kangnam Chemical), 6 g of thixotropic agent Attagel-50 (Engelhard), 0.05 g of coupling agent B515.1 2H (Chartwell), 2 g of cryolite (Onoda), and 66.95 g of silicon carbide #320 abrasive (ESK) were mixed with 25 g of methanol to obtain a second abrasive slurry having a viscosity of 15,000 centipoise (at 25° C.) and a solid content of 74% by weight.

Figure 5A:
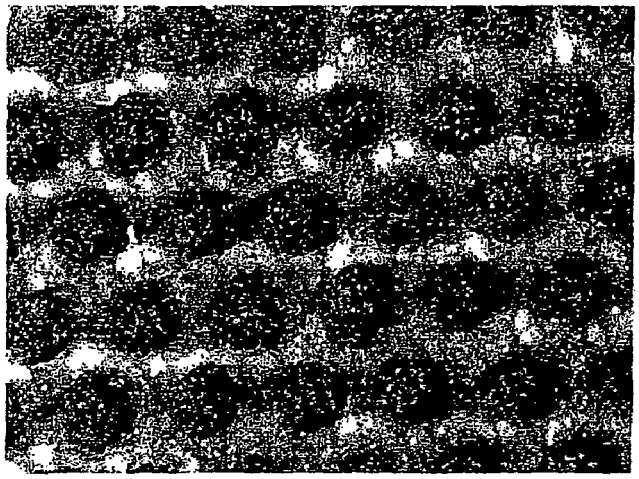
FIG. 5A: a plane view of the three-dimensional abrasive structures formed on a backing.
Figure 5B:
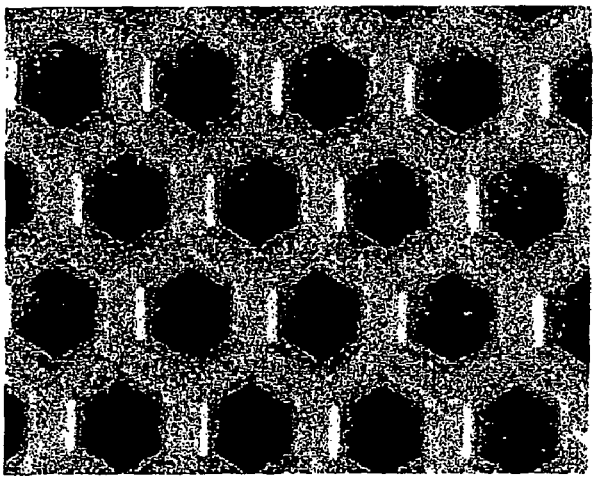
FIG. 5B: a plane view of a screen mesh used in forming the three-dimensional abrasive structures.
Figure 6A:
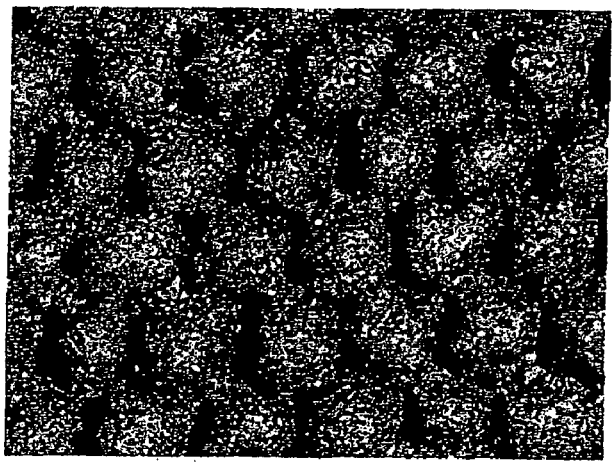
FIGS. 6A and 6B: a plane view and a cross-sectional view of the coated abrasive obtained by the inventive method, respectively.
Figure 6B:
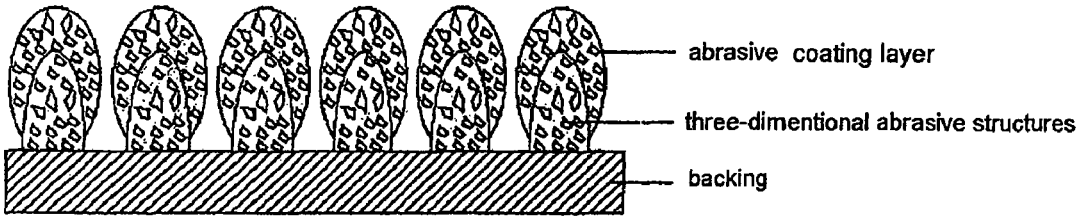

The first abrasive slurry was coated on polyester/cotton mixed yarn fabric BT65 (Suntek Industries) in an amount of 225 g/m$^2$ using a screen mesh roll coater having a mesh diameter (inner diameter) of 650 μm as shown in FIG. 5B, and then dried for 5 seconds using a super high pressure mercury lamp or a metal halide lamp which emits electromagnetic radiation having a wavelength of 500 nm, to obtain corn-shaped three-dimensional abrasive structures. The three-dimensional structures had a diameter of 650 μm and a height of 320 μm, and the distance between the structures was 1,050 μm.

Subsequently, the spray-coating of the second abrasive slurry was conducted over the three-dimensional abrasive structures at an angle calculated by formula I, i.e., 23.80, in an amount of 770 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive.

Example 2

25 g of phenol resin HP-41 (Kangnam Chemical), 3 g of thixotropic agent Attagel-50 (Engelhard), 0.05 g of coupling agent B515.1 2H (Chartwell), 2 g of cryolite (Onoda), and 69.95 g of silicon carbide #320 abrasive (ESK) were mixed with 7.44 g of propyleneglycol methyl ether to obtain a first abrasive slurry having a viscosity of 55,000 centipoise (at 25° C.) and a solid content of 87% by weight. Further, a second abrasive slurry was made by the same method as used in Example 1.

The first abrasive slurry was coated on polyester/cotton mixed yarn fabric BT65 (Suntek Industries) in an amount of 226 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 320 μm, and the distance between the structures was 1,050 μm.

Subsequently, the spray-coating of the second abrasive slurry was conducted over the three-dimensional abrasive structures at an angle calculated by formula I, i.e., 23.80, in an amount of 765 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 3

25 g of epoxy resin LER-850 (Hexion), 1.5 g of thixotropic agent Attagel-50 (Engelhard), 0.05 g of coupling agent B515.1 2H (Chartwell), 2.5 g of epoxy curing agent DF (Donghae Chemicals), 2 g of cryolite (Onoda), and 68.95 g of silicon carbide #320 abrasive (ESK) were mixed with 8.7 g of propyleneglycol methyl ether to obtain a first abrasive slurry having a viscosity of 25,000 centipoise (at 25° C.) and a solid content of 92% by weight. Further, a second abrasive slurry was made by the same method as used in Example 1.

The first abrasive slurry was coated on polyester/cotton mixed yarn fabric BT65 (Suntek Industries) in an amount of 230 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 340 μm, and the distance between the structures was 1,050 μm.

Subsequently, the spray-coating of the second abrasive slurry was conducted over the three-dimensional abrasive structures at an angle calculated by formula I, i.e., 25.1°, in an amount of 741 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 4

21 g of phenol resin HP-41 (Kangnam Chemical), 4.2 g of epoxy resin LER-850 (Hexion), 1.5 g of thixotropic agent Attagel-50 (Engelhard), 0.05 g of coupling agent B515.1 2H (Chartwell), 2 g of cryolite (Onoda), and 71.25 g of silicon carbide #320 abrasive (ESK) were mixed with 6.10 g of propyleneglycol methyl ether to obtain a first abrasive slurry having a viscosity of 45,000 centipoise (at 25° C.) and a solid content of 89% by weight. Further, a second abrasive slurry was made by the same method as used in Example 1.

The first abrasive slurry was coated on polyester/cotton mixed yarn fabric BT65 (Suntek Industries) in an amount of 232 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 340 μm, and the distance between the structures was 1,050 μm.

Subsequently, the spray-coating of the second abrasive slurry was conducted over the three-dimensional abrasive structures at an angle calculated by formula I, i.e., 25.1°, in an amount of 760 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 5

A first abrasive slurry was made by the same method as used in Example 2. Meanwhile, 40 g of phenol resin HP-41 (Kangnam Chemical), 6 g of thixotropic agent Attagel-50 (Engelhard), 0.05 g of coupling agent B515.1 2H (Chartwell), 2.35 g of cryolite (Onoda), and 51.6 g of silicon carbide #320 abrasive (ESK) were mixed with 35 g of methanol to obtain a second abrasive slurry having a viscosity of 2,000 centipoise (at 25° C.) and a solid content of 68% by weight.

The first abrasive slurry was coated on polyester/cotton mixed yarn fabric BT65 (Suntek Industries) in an amount of 237 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 360 μm, and the distance between the structures was 1,050 μm.

Subsequently, the spray-coating of the second abrasive slurry was conducted over the three-dimensional abrasive structures at an angle calculated by formula I, i.e., 26.4°, in an amount of 760 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 6

A first abrasive slurry was made by the same method as used in Example 3. Meanwhile, a second abrasive slurry was made by the same method as used in Example 5.

The first abrasive slurry was coated on polyester/cotton mixed yarn fabric BT65 (Suntek Industries) in an amount of 235 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 360 μm, and the distance between the structures was 1,050 μm.

Subsequently, the spray-coating of the second abrasive slurry was conducted over the three-dimensional abrasive structures at an angle calculated by formula I, i.e., 26.4°, in an amount of 763 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 7

A first abrasive slurry was made by the same method as used in Example 4. Meanwhile, a second abrasive slurry was made by the same method as used in Example 5.

The first abrasive slurry was coated on polyester/cotton mixed yarn fabric BT65 (Suntek Industries) in an amount of 234 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional structures had a diameter of 650 μm and a height of 350 μm, and the distance between the structures was 1,050 μm.

Subsequently, the spray-coating of the second abrasive slurry was conducted over the three-dimensional abrasive structures at an angle calculated by formula I, i.e., 25.8°, in an amount of 755 g/m$^2$, and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive of the present invention.

Example 8

A first abrasive slurry was made by the same method as used in Example 2. Meanwhile, 69.5 g of phenol resin HP-41 (Kangnam Chemical), 30 g of cryolite (Onoda), and 0.5 g of coupling agent B515.1 2H (Chartwell) were mixed with 22 g of propyleneglycol methyl ether to obtain a first adhesive composition having a viscosity of 700 centipoise (at 25° C.) and a solid content of 70% by weight. The first adhesive composition was also used as a second adhesive composition.

The first abrasive slurry was coated on polyester/cotton mixed yarn fabric BT65 (Suntek Industries) in an amount of 231 g/m$^2$ using a screen mesh roll coater having a mesh diameter (inner diameter) of 650 μm, and then dried at a temperature of 90 to 140° C. for 20 minutes, to obtain corn-shaped three-dimensional abrasive structures. The three-dimensional abrasive structures had a diameter of 650 μm and a height of 340 μm, and the distance between the structures was 1,050 μm.

Subsequently, the spray-coating of the first adhesive composition was conducted over the three-dimensional abrasive structures at an angle calculated by formula I, i.e., 25.1°, in an amount of 105 g/m$^2$, followed by the electrostatic coating of silicon carbide #320 (ESK) of 210 g/m$^2$ as an abrasive and subsequently drying at a temperature of 90 to 140° C. for 50 minutes to obtain the first adhesive layer in which the abrasive was dispersed. Then, spray coating of the second adhesive composition was conducted on the first adhesive layer at an angle calculated by formula II, i.e., 29°, in an amount of 71 g/m$^2$, and then dried at a temperature of 90 to 140° C. for 80 minutes, to obtain a second adhesive layer. Consequently, three-dimensional abrasive structures coated on the backing were formed.

The resulting pre-cured coated abrasive was cured at a temperature which was programmed to rise continuously from 100 to 120° C. over a period of 10 hours, to obtain a coated abrasive of the present invention.

Comparative Example 1

84.5 g of phenol resin HP-41 (Kangnam Chemical), 15 g of calcium carbonate (Woojin Chemical), and 0.5 g of wetting agent Q2-5211 (Dow coming) were mixed with 14.75 g of a mixture of propyleneglycol methyl ether to water of 1:4 to obtain a first adhesive composition having a viscosity of 1,200 centipoise (at 25° C.) and a solid content of 75% by weight. In addition, 89.7 g of phenol resin HP-41 (Kangnam Chemical), 10 g of calcium carbonate (Woojin Chemical), 0.3 g of wetting agent Q2-5211 (Dow coming) were mixed with 5 g of a mixture of propyleneglycol methyl ether to water of 1:4 to obtain a second adhesive composition having a viscosity of 1,000 centipoise (at 25° C.) and a solid content of 76% by weight.

The first adhesive composition was coated on polyester/cotton mixed yarn fabric BT65 (Suntek Industries) in an amount of 35 g/m$^2$ using a three-roll coater, followed by the electrostatic coating of silicon carbide #320 (ESK) of 135 g/m$^2$ as an abrasive and subsequently drying at a temperature of 90 to 120° C. for 60 minutes to obtain a first adhesive layer in which the abrasive was dispersed. Then, the second adhesive composition was coated on the first adhesive layer using a two-roll coater in an amount of 63 g/m$^2$, and then dried at a temperature 90 to 110° C. for 80 minutes, to obtain a second adhesive layer.

The resulting pre-cured coated abrasive was cured at a temperature which was programmed to rise continuously from 100 to 120° C. over a period of 10 hours, to obtain a conventional coated abrasive as shown in FIG. 1.

Comparative Example 2

80 g of phenol resin HP-41 (Kangnam Chemical), and 20 g of calcium carbonate (Woojin Chemical) were mixed with 14 g of a mixture of propyleneglycol methyl ether to water of 1:4 to obtain a first adhesive composition having a viscosity of 1,500 centipoise (at 25° C.) and a solid content of 76% by weight. In addition, a phenol resin HP-41 (Kangnam Chemical) of 65 g, and cryolite (Onoda) of 35 g were mixed with a mixture of 19.4 g of propyleneglycol methyl ether to water of 1:4 to obtain a first-2 adhesive composition having a viscosity of 300 centipoise (at 25° C.) and a solid content of 72% by weight.

Separately, 70 g of phenol resin HP-41 (Kangnam Chemical), and 30 g of $KBF_4$ (Solvay in Germany) were mixed with 16.15 g of a mixture of propyleneglycol methyl ether to water of 1:4 to obtain a second-1 adhesive composition having a viscosity of 1,500 centipoise (at 25° C.) and a solid content of 76% by weight. In addition, 80 g of phenol resin HP-41 (Kangnam Chemical), and 20 g of cryolite (Onoda) were mixed with 15 g of a mixture of propyleneglycol methyl ether to water of 1:4 to obtain a second-2 adhesive composition having a viscosity of 300 centipoise (at 25° C.) and a solid content of 72% by weight.

Figure 2:
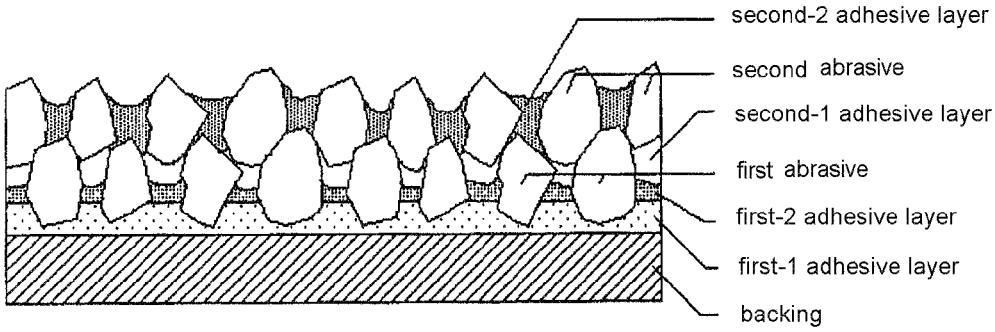

The first-1 adhesive composition was coated on polyester/cotton mixed yarn fabric BT65 (Suntek Industries) in an amount of 42 g/m$^2$ using a three-roll coater, followed by the electrostatic coating of an alumina #320 (Treibacher) of 139 g/m$^2$ as an abrasive and subsequently drying at a temperature of 70 to 115° C. for 80 minutes. Then, the first-2 adhesive composition was coated on the above layer using a two-roll coater in an amount of 73 g/m$^2$, and then pre-dried at a temperature 70 to 120° C. for 3 hours. Subsequently, in the absence of the curing process, the second-1 adhesive composition was coated on the above layer in an amount of 95 g/m$^2$ using a three-roll coater, followed by the electrostatic coating of an alumina #320 (Treibacher) of 120 g/m$^2$ as an abrasive and by drying at a temperature of 75 to 115° C. for 120 minutes. Next, the second-2 adhesive composition was coated on the above layer in an amount of 70 g/m$^2$ using a two-roll coater, followed by drying at a temperature of 75 to 125° C. for 3 hours and being cured at a temperature of 125° C. for 3 hour. Then, a conventional coated abrasive as shown in FIG. 2 was prepared.

Comparative Example 3

Figure 3:
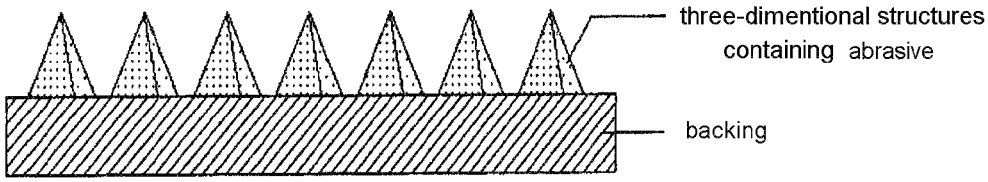

Trizact 307EA A65 made by 3M was used as a coated abrasive having the pyramidal three-dimensional abrasive structures as shown in FIG. 3.

Comparative Example 4

39.7 g of phenol resin HP-41 (Kangnam Chemical), and 60 g of calcium carbonate (Woojin Chemical), and 0.3 g of wetting agent Q2-5211 (Dow corning) were mixed with 5.75 g of a mixture of propyleneglycol methyl ether to water of 1:4 to obtain a first adhesive composition having a viscosity of 3,000 centipoise (at 25° C.) and a solid content of 85% by weight. In addition, 39.9 g of phenol resin HP-41 (Kangnam Chemical), 40 g of calcium carbonate (Woojin Chemical), 20 g of cryolite (Onoda), and 0.1 g of coupling agent B515.1 2H (Chartwell) were mixed with 21.35 g of mixture of propyleneglycol methyl ether to water of 1:4 to obtain a second adhesive composition having a viscosity of 500 centipoise (at 25° C.) and a solid content of 75% by weight.

The first adhesive composition was coated on polyester/cotton mixed yarn fabric BT65 (Suntek Industries) in an amount of 190 g/m$^2$ using a three-roll coater, followed by the coating of an agglomerated minerals having a diameter of 750 to 900 μm, made of silicon carbide #320 and a phenol resin in an amount of 500 g/m$^2$ and subsequently drying at a temperature of 90 to 120° C. for 90 minutes. Then, the second adhesive composition was coated on the above layer using a two-roll coater in an amount of 350 g/m$^2$, and then dried at a temperature of 90 to 110° C. for 120 minutes, to obtain a second adhesive layer.

Figure 4:
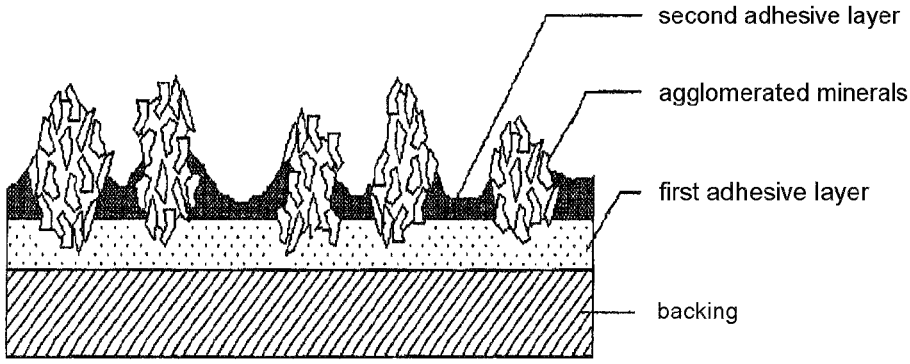

The resulting pre-cured coated abrasive was cured at a temperature which was programmed to rise continuously from 100 to 120° C. over a period of 10 hours, to obtain a conventional coated abrasive as shown in FIG. 4.

Comparative Example 5

A first abrasive slurry was made by the same method as used in Example 1. Further, 80 g of phenol resin HP-41 (Kangnam Chemical), 13.9 g of cryolite (Onoda), 6 g of thixotropic agent Attagel-50 (Engelhard), and 0.1 g of coupling agent B515.1 2H (Chartwell) were mixed with 4.11 g of propyleneglycol methyl ether to obtain a first abrasive slurry having a viscosity of 1,300 centipoise (at 25° C.) and a solid content of 78% by weight. In addition, 69.5 g of phenol resin HP-41 (Kangnam Chemical), 30 g of cryolite (Onoda), and 0.5 g of coupling agent B515.1 2H (Chartwell) were mixed with 22.09 g of propyleneglycol methyl ether to obtain a second adhesive composition having a viscosity of 700 centipoise (at 25° C.) and a solid content of 70% by weight.

The first abrasive slurry was coated on polyester/cotton mixed yarn fabric BT65 (Suntek Industries) in an amount of 220 g/m$^2$ using a screen mesh roll coater having a mesh diameter (inner diameter) of 650 μm, and then dried for 5 seconds using a super high pressure mercury lamp or a metal halide lamp which emits electromagnetic radiation having a wavelength of 500 nm, to obtain corn-shaped three-dimensional abrasive structures. The three-dimensional abrasive structures had a diameter of 650 μm and a height of 350 μm, and the distance between the structures was 1,050 μm.

Consequently, the first adhesive composition was coated on the three-dimensional abrasive structures in an amount of 120 g/m$^2$ using a three-roll coater, followed by the electrostatic coating of silicon carbide #320 (ESK) of 200 g/m$^2$ as an abrasive and drying at a temperature of 90 to 140° C. for 50 minutes. Subsequently, the second adhesive was coated on the above layer in an amount of 100 g/m$^2$ using a two-roll coater and then dried at a temperature of 90 to 140° C. for 80 minutes.

The resulting pre-cured coated abrasive was cured at a temperature which was programmed to rise continuously from 100 to 120° C. over a period of 10 hours, to obtain a coated abrasive.

Physical Properties Test

The stock removal, grinding time, grinding surface roughness and flexibility were measured for each the coated abrasive prepared in Examples 1 to 8 and Comparative Examples 1 to 5, and the results are shown in Table 1.

TABLE 1

| | Stock removal (g)*1 | grinding time (minutes)*2 | grinding surface roughness (μm)*3 | Flexibility*4 |
|---|---|---|---|---|
| Example 1 | 29 | 24 | $R_{max}$: 2.84, $R_a$: 0.43 | 3 |
| Example 2 | 39 | 29 | $R_{max}$: 2.99, $R_a$: 0.45 | 3 |
| Example 3 | 34 | 25 | $R_{max}$: 2.93, $R_a$: 0.44 | 3 |
| Example 4 | 36 | 27 | $R_{max}$: 2.87, $R_a$: 0.43 | 3 |
| Example 5 | 60 | 45 | $R_{max}$: 3.01, $R_a$: 0.45 | 3 |
| Example 6 | 52 | 39 | $R_{max}$: 2.95, $R_a$: 0.44 | 3 |
| Example 7 | 55 | 41 | $R_{max}$: 2.89, $R_a$: 0.43 | 3 |
| Example 8 | 24 | 18 | $R_{max}$: 2.69, $R_a$: 0.43 | 3 |
| Comparative Example 1 | 4 | 5 | $R_{max}$: 2.74, $R_a$: 0.41 | 2 |

TABLE 1-continued

| | Stock removal (g)*1 | grinding time (minutes)*2 | grinding surface roughness (μm)*3 | Flexibility*4 |
|---|---|---|---|---|
| Comparative Example 2 | 6 | 8 | $R_{max}$: 2.77, $R_a$: 0.43 | 5 |
| Comparative Example 3 | 17 | 13 | $R_{max}$: 2.54, $R_a$: 0.40 | 4 |
| Comparative Example 4 | 46 | 35 | $R_{max}$: 2.78, $R_a$: 0.48 | 3.5 |
| Comparative Example 5 | 21 | 16 | $R_{max}$: 2.73, $R_a$: 0.41 | 3.5 |

<grinding test> automatic robot grinding tester (Matsuda Japan)
Coated abrasive belt standard: 60 mm × 2100 mm (width × length)
Coated abrasive belt rotation rate: 1050 rpm
Pressure: 10.0 Lbsf.
Contact wheel diameter and hardness: ϕ 355 mm, 60° durometer
work piece: titanium ASTM G5 25.4 mm × 80.0 mm × 200.0 mm (width × height × length)
Grinding condition: Subjecting an grinding target to repeat up and down grinding six times over a period of 30 seconds
*1stock removal - the total stock removal until when the life time of belt is worn-out of abrasive grains (the measurement every 30 seconds)
*2grinding time - the time for the belt reach the end of its use life
*3grinding surface roughness - the measurement for the surface of the grinding target every ten cycles
*4pliableness ←----------I----------→ stiffness
1 5 10

As shown in Table 1, the coated abrasives of the present invention prepared in Examples 1 to 8 exhibit much improved properties in terms of the stock removal, grinding time and flexibility as compared to Comparative Examples 1 to 3 and 5. Further, the variation in the surface roughness was not large for the inventive sheets. Although Comparative Example 4 shows a good cutting performance and grinding time, the variation of surface roughness is very large, which may create scratches on the work piece surface.

As described above, the coated abrasive prepared by the method of the present invention shows improved flexibility and surface roughness, and, therefore, it may be used to grind any plane or curved surface. Further, the life time of the inventive coated abrasive is five to ten times higher than the conventional coated abrasive.

What is claimed is:

1. A method for preparing a coated abrasive having three-dimensional abrasive structures, comprising:

(a) forming a plurality of abrasive structures having a three-dimensional shape on a backing by using a first abrasive slurry and drying the abrasive structures, and (b) spray-coating a second abrasive slurry over the three-dimensional abrasive structures to form a coating layer thereon and drying the coating layer, wherein the second abrasive slurry is sprayed over the abrasive structures at an angle (A) calculated by formula I:

$$A = \text{atan}\{H/(D-R/2)\} \quad \text{(I)}$$

in which A is the angle between the line of spray and the horizontal line, H and R are the height (μm) and the diameter (μm) of the three-dimensional abrasive structure, respectively, and D is the distance (μm) between two adjacent three-dimensional abrasive structures.

2. The method for preparing a coated abrasive of claim 1, wherein the first abrasive slurry comprises 40 to 70% by weight of abrasive grains, 20 to 50% by weight of an adhesive and 2 to 30% by weight of a filler based on the total weight of a solid content of the slurry.

3. The method for preparing a coated abrasive of claim 1, wherein the first abrasive slurry used in step (a) has a viscosity of 25,000 to 60,000 centipoise (at 25° C.) and a solid content of 80 to 95% by weight.

4. The method for preparing a coated abrasive of claim 1, wherein the first abrasive slurry in step (a) is coated in an amount of 100 to 1,000 g/m$^2$ on the backing.

5. The method for preparing a coated abrasive of claim 1, wherein the three-dimensional abrasive structures formed in step (a) has a diameter of 300 to 2,500 μm and a height of 300 to 1,000 μm, and the distance between the structures is 500 to 3,000 μm.

6. The method for preparing a coated abrasive of claim 1, wherein the three-dimensional abrasive structures formed in step (a) has a shape of cone, semicircle, cylinder or square pillar.

7. The method for preparing a coated abrasive of claim 1, wherein the first abrasive slurry in step (a) is coated by using a screen mesh roll coater.

8. The method for preparing a coated abrasive of claim 7, wherein the hole size of the screen mesh roll coater is 300 to 2,000 μm in diameter.

9. The method for preparing a coated abrasive of claim 1, wherein A is in the range of 10 to 70°.

10. The method for preparing a coated abrasive of claim 1, wherein the spray-coating is carried out using at least one injection nozzle located at a position above the three-dimensional abrasive structures formed on the backing.

11. The method for preparing a coated abrasive of claim 1, wherein the second abrasive slurry used in step (b) has a viscosity of 1,000 to 3,000 centipoise (25° C.) and a solid content of 60 to 80% by weight.

12. The method for preparing a coated abrasive of claim 1, wherein the second abrasive slurry is coated in an amount of 500 to 1,200 g/m$^2$ on the three-dimensional abrasive structures.

13. The method for preparing a coated abrasive of claim 1, wherein the three-dimensional abrasive structures formed in step (b) have an average height of 300 to 1,000 μm.

14. A method for preparing a coated abrasive having three-dimensional abrasive structures, comprising:

(a) forming a plurality of abrasive structures having a three-dimensional shape on a backing by using a first abrasive slurry and drying the abrasive structures, (b) spray-coating a first abrasive composition over the three-dimensional abrasive structures, electrostatic-coating abrasive grains, followed by drying, to form a first adhesive layer, wherein the first adhesive composition is sprayed over the abrasive structures with an angle (A) calculated by the formula I:

$$A = \text{atan}\{H/(D-R/2)\} \quad \text{(I)}$$

(c) spray-coating a second adhesive composition over the first adhesive layer, followed by drying to form a second adhesive layer, in which the second adhesive composition is sprayed over the first adhesive layer at an angle (A') calculated by the formula II:

$$A'\text{atan}\{H'/(D-R/2)\} \quad \text{(II)}$$

in which A or A' is the angle between the line of spray and the horizontal line, H and R are the height (μm) and the diameter (μm) of the three-dimensional abrasive structure, respectively, H' is the height of the three-dimensional abrasive structures obtained in (b), and D is the distance (μm) between two adjacent three-dimensional abrasive structures.

15. The method for preparing a coated abrasive of claim 14, wherein the first adhesive composition used in step (b) has a viscosity of 1,000 to 2,000 centipoise (25° C.) and a solid content of 70 to 80% by weight, which is coated in an amount of 70 to 250 g/m$^2$.

16. The method for preparing a coated abrasive of claim 14, wherein the 30 second adhesive composition used in step (c) has a viscosity of 500 to 2,000 centipoise (25° C.) and a solid content of 60 to 80% by weight, which is coated in an amount of 50 to 300 g/m$^2$.

17. The method for preparing a coated abrasive of claim 14, wherein the amount of abrasive grain used in step (b) is coated in the range of 100 to 600 g/m$^2$.

18. The method for preparing a coated abrasive of claim 14, wherein the first abrasive slurry used in step (a) has a viscosity of 25,000 to 60,000 centipoise (at 25° C.) and a solid content of 80 to 95% by weight.

19. The method for preparing a coated abrasive of claim 14, wherein R is 300 to 2,500 μm, H is 300 to 1,000 μm, and D is 500 to 3,000 μm.

20. The method for preparing a coated abrasive of claim 14, wherein A is in the range of 10 to 70°.

* * * * *